US010769998B2

(12) United States Patent
Xu

(10) Patent No.: US 10,769,998 B2
(45) Date of Patent: Sep. 8, 2020

(54) PIXEL CIRCUIT AND DRIVING METHOD THEREOF, ARRAY SUBSTRATE, AND DISPLAY PANEL

(71) Applicants: BOE TECHNOLOGY GROUP CO., LTD., Beijing (CN); CHENGDU BOE OPTOELECTRONICS TECHNOLOGY CO., LTD., Chengdu (CN)

(72) Inventor: Yingsong Xu, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu (CN)

( * ) Notice: Subject to any disclaimer, the term of this patent is extended or adjusted under 35 U.S.C. 154(b) by 0 days.

(21) Appl. No.: 16/225,633

(22) Filed: Dec. 19, 2018

(65) Prior Publication Data

US 2019/0362674 A1 Nov. 28, 2019

(30) Foreign Application Priority Data

May 28, 2018 (CN) ..... 2018 1 0523030

(51) Int. Cl.
*G09G 3/3241* (2016.01)
*G09G 3/32* (2016.01)
(Continued)

(52) U.S. Cl.
CPC ..... *G09G 3/3241* (2013.01); *G09G 3/32* (2013.01); *G09G 3/3233* (2013.01);
(Continued)

(58) Field of Classification Search
CPC .. G09G 2320/043; G09G 3/3241; G09G 3/32; G09G 2300/0819; G09G 2320/0204;
(Continued)

(56) References Cited

U.S. PATENT DOCUMENTS

2009/0046084 A1* 2/2009 Lim ..... G09G 3/20 345/205
2016/0042694 A1 2/2016 Lim et al.
2018/0130418 A1 5/2018 Zhu et al.

FOREIGN PATENT DOCUMENTS

CN 104751781 A 7/2015
CN 105654904 A 6/2016
CN 105741779 A 7/2016

OTHER PUBLICATIONS

China First Office Action, Application No. 201810523030.9, dated Aug. 28, 2019, 20 pps.: with English translation.

* cited by examiner

*Primary Examiner* — Julie Anne Watko
(74) *Attorney, Agent, or Firm* — Armstrong Teasdale LLP

(57) ABSTRACT

Embodiments of the present disclosure provide a pixel circuit and a drive method thereof, an array substrate, and a display panel. The pixel circuit includes a drive transistor, a data write circuit, a light emission control circuit, a compensation circuit, a reset circuit, and a light emitting device. A first control electrode of the drive transistor is coupled to a first node, a second control electrode of the drive transistor is coupled to a second node, a first electrode of the drive transistor is coupled to a first voltage signal terminal, and a second electrode of the drive transistor is coupled to a third node and may provide a drive current. The light emitting device is coupled between the light emission control circuit and a second voltage signal terminal and may emit light based on the drive current.

9 Claims, 6 Drawing Sheets

(51) Int. Cl.
*G09G 3/3233* (2016.01)
*G09G 3/3225* (2016.01)

(52) U.S. Cl.
CPC ... *G09G 3/3225* (2013.01); *G09G 2300/0819* (2013.01); *G09G 2300/0852* (2013.01); *G09G 2300/0861* (2013.01); *G09G 2320/0204* (2013.01); *G09G 2320/0223* (2013.01); *G09G 2320/0233* (2013.01); *G09G 2320/045* (2013.01)

(58) Field of Classification Search
CPC ..... G09G 2320/0233; G09G 2320/045; G09G 3/325; G09G 3/3233; G09G 3/3225; G09G 3/3208; G09G 3/30; G09G 3/22; G09G 3/20; G09G 3/00; G09G 2300/0809; G09G 2300/08; G09G 2300/00; G09G 2320/02; G09G 2320/00; G09G 2320/04; G09G 2320/0223; G09G 2300/0852; G09G 2300/0861
See application file for complete search history.

PIXEL CIRCUIT AND DRIVING METHOD THEREOF, ARRAY SUBSTRATE, AND DISPLAY PANEL

CROSS REFERENCE TO RELATED APPLICATIONS

This patent application claims the benefit and priority of Chinese Patent Application No. 201810523030.9 filed on May 28, 2018, the disclosure of which is incorporated by reference herein in its entirety as part of the present application.

BACKGROUND

The present disclosure relates to the field of display technologies, and more particularly, to a pixel circuit and a method for driving a pixel circuit, an array substrate, and a display panel.

With the progress of display technologies, a new generation of organic light emitting diode (OLED) display apparatuses have lower manufacturing cost, faster response speed, higher contrast ratio, wider viewing angle, and larger operating temperature range than conventional liquid crystal display (LCD) apparatuses. Furthermore, the OLED display apparatuses do not need backlight units, and have advantages such as bright color and light weight. Therefore, OLED display technologies have become the currently fastest-growing display technologies.

The current mainstream developing target of the OLED is to control the magnitude of the current between the source and the drain of a drive transistor by changing the gate voltage of the drive transistor directly driving the OLED to emit light so as to implement variation of the light emission luminance. However, in the process of fabricating the drive transistor, the threshold voltage of the drive transistor may be different at different locations due to process variation. Furthermore, as the working time passes and the operating environment changes, the threshold voltage of the drive transistor may drift. In another aspect, in a display device, different locations for the pixels may also cause different voltage drops (I-R Drops) of a power source, which may affect the driving current of the OLED.

BRIEF DESCRIPTION

Embodiments of the present disclosure provide a pixel circuit and a method for driving a pixel circuit, an array substrate, and a display panel.

A first aspect of the present disclosure provides a pixel circuit. The pixel circuit may include a drive transistor, a data write circuit, a light emission control circuit, a compensation circuit, a reset circuit, and a light emitting device. A first control electrode of the drive transistor is coupled to a first node, a second control electrode of the drive transistor is coupled to a second node, a first electrode of the drive transistor is coupled to a first voltage signal terminal, and a second electrode of the drive transistor is coupled to a third node. The drive transistor may be configured to provide a drive current. The data write circuit may be configured to provide a reference signal or a data signal from a data line to the first node based on a first drive signal from a first drive signal terminal. The light emission control circuit may be configured to control, based on a pixel drive signal from a pixel drive signal terminal, to provide the drive current to the light emitting device. The compensation circuit may be configured to control a voltage of the second node to be equal to a voltage of the third node based on a second drive signal from a second drive signal terminal. The reset circuit may be configured to provide a third voltage signal from a third voltage signal terminal to the second node based on a reset signal from a reset signal terminal. The light emitting device may be coupled between the light emission control circuit and a second voltage signal terminal and may be configured to emit light based on the drive current.

In embodiments of the present disclosure, the data write circuit may include a first transistor. A control electrode of the first transistor is coupled to the first drive signal terminal, a first electrode of the first transistor is coupled to the data line, and a second electrode of the first transistor is coupled to the first node.

In embodiments of the present disclosure, the light emission control circuit may include a second transistor. A control electrode of the second transistor is coupled to the pixel drive signal terminal, a first electrode of the second transistor is coupled to the third node, and a second electrode of the second transistor is coupled to the light emitting device.

In embodiments of the present disclosure, the compensation circuit may include a third transistor. A control electrode of the third transistor is coupled to the second drive signal terminal, a first electrode of the third transistor is coupled to the second node, and a second electrode of the third transistor is coupled to the third node.

In embodiments of the present disclosure, the reset circuit may include a fourth transistor. A control electrode of the fourth transistor is coupled to the reset signal terminal, a first electrode of the fourth transistor is coupled to the third voltage signal terminal, and a second electrode of the fourth transistor is coupled to the second node.

In embodiments of the present disclosure, the light emitting device may include one of a light emitting diode, an organic light emitting diode, and an active matrix organic light emitting diode.

In embodiments of the present disclosure, the pixel circuit may further include a voltage holding circuit. The voltage holding circuit may be configured to hold a voltage difference between the first voltage signal terminal and the first node, and/or hold a voltage difference between the first voltage signal terminal and the second node.

In embodiments of the present disclosure, the voltage holding circuit may include a first capacitor and/or a second capacitor. The first capacitor may be coupled between the first voltage signal terminal and the first node. The second capacitor may be coupled between the first voltage signal terminal and the second node.

In embodiments of the present disclosure, the first drive signal may be a gate drive signal for the pixel circuit, and the second drive signal may be a gate drive signal for another pixel circuit.

In embodiments of the present disclosure, a voltage of the data signal is smaller than a voltage of the reference signal, and the voltage of the reference signal is smaller than a voltage of the first voltage signal from the first voltage signal terminal.

A second aspect of the present disclosure provides a method for driving the pixel circuit according to the first aspect of the present disclosure. In this method, the reset signal, the second drive signal, and the pixel drive signal may be provided, such that the voltage of the second node is equal to the voltage of the third node, and the drive current of the drive transistor is provided to the third voltage signal terminal via the compensation circuit and the reset circuit to reset the light emitting device. The second drive signal may be provided, such that the voltage of the second node and the voltage of the third node rise to the equal voltage, and the first drive signal may be provided so as to provide the reference signal to the first node, such that a threshold voltage of the drive transistor is a voltage difference between a voltage of the reference signal and a voltage of a first voltage signal from the first voltage signal terminal. The first drive signal may be provided so as to provide the data signal to the first node, and the threshold voltage of the drive transistor may be held to be the voltage difference between the voltage of the reference signal and the voltage of the first voltage signal. Next, the pixel drive signal may be provided, such that the light emitting device emits light based on the drive current of the drive transistor.

A third aspect of the present disclosure provides an array substrate. The array substrate may include a plurality of pixel circuits according to the first aspect of the present disclosure. The plurality of pixel circuits may be arranged in a matrix.

In embodiments of the present disclosure, the array substrate may further include a plurality of cascade-coupled gate driving transistors. A gate drive signal provided by the $(n-1)^{th}$ stage gate driving transistor serves as the second drive signal of the $n^{th}$ row of pixel circuits, and a gate drive signal provided by the $n^{th}$ stage gate driving transistor serves as the first drive signal of the $n^{th}$ row of pixel circuits.

A fourth aspect of the present disclosure provides a display panel. The display panel includes the array substrate according to the third aspect of the present disclosure.

BRIEF DESCRIPTION OF THE DRAWINGS

To describe the technical solutions of the present disclosure more clearly, the accompanying drawings of the embodiments will be briefly introduced below. It is to be known that the accompanying drawings in the following description merely involve with some embodiments of the present disclosure, but not limit the present disclosure.

DETAILED DESCRIPTION

To make technical solutions and advantages of the embodiments of the present disclosure clearer, the technical solutions in the embodiments of the present disclosure will be described clearly and completely below, in conjunction with the accompanying drawings. Apparently, the described embodiments are merely some but not all of the embodiments of the present disclosure. All other embodiments obtained by those of ordinary skill in the art based on the described embodiments without creative efforts shall fall within the protection scope of the present disclosure.

In the description of the present disclosure, unless otherwise stated, the term "a plurality of" means two or more than two. The orientation or position relations represented by the terms of "above", "beneath", "left", "right", "inside", "outside" and the like are orientation or position relations shown based on the accompanying figures, they are merely for ease of a description of the present disclosure and a simplified description instead of being intended to indicate or imply the device or element to have a special orientation or to be configured and operated in a special orientation. Thus, they cannot be understood as limiting of the present disclosure.

In the description of the present disclosure, it is to be noted that unless explicitly specified or limited otherwise, terms "installation", "connecting" or "coupling" should be understood in a broad sense, which may be, for example, a fixed connection, a detachable connection or integrated connection, a mechanical connection or an electrical connection, a direct connection or indirect connection by means of an intermediary. For those of ordinary skill in the art, specific meanings of the above terms in the present disclosure may be understood based on specific circumstances.

Figure 1:
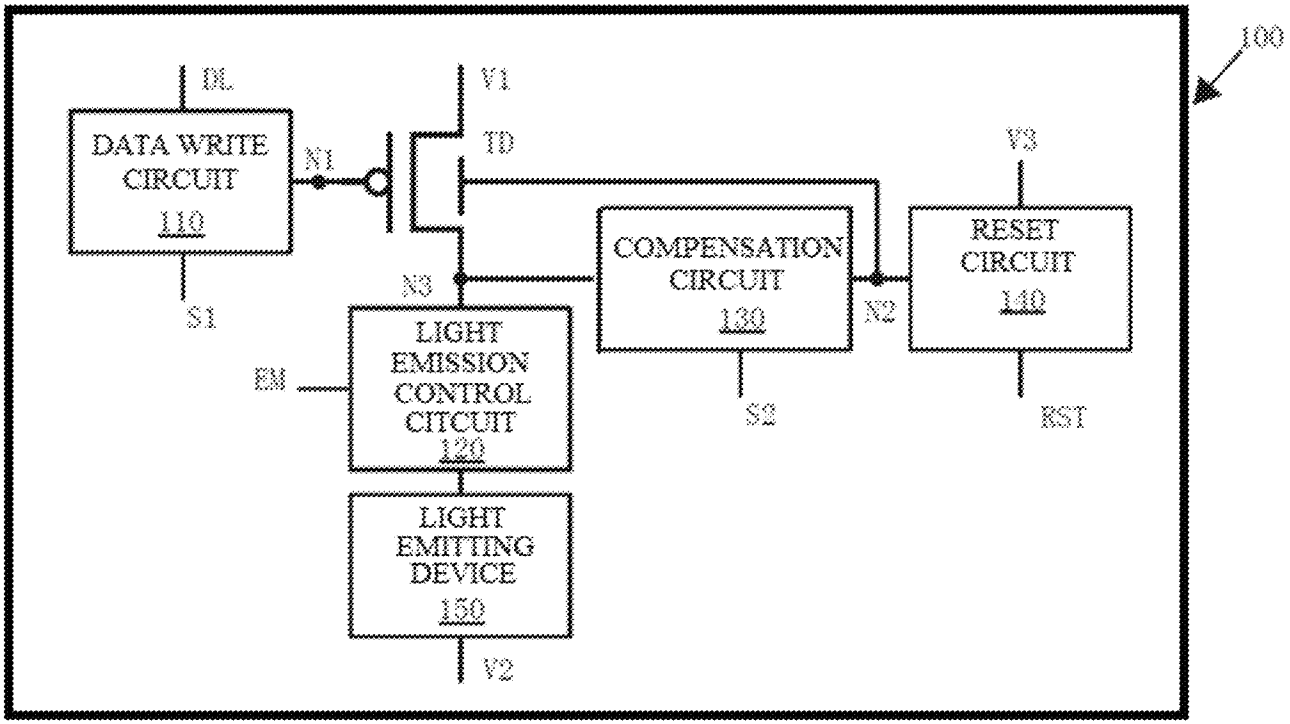
FIG. 1 illustrates a schematic block diagram of a pixel circuit according to an embodiment of the present disclosure.

FIG. 1 illustrates a schematic block diagram of a pixel circuit according to an embodiment of the present disclosure. As shown in FIG. 1, the pixel circuit 100 may include a drive transistor TD, a data write circuit 110, a light emission control circuit 120, a compensation circuit 130, a reset circuit 140, and a light emitting device 150.

In embodiments of the present disclosure, the drive transistor TD is a double-gate transistor. In the embodiments of the present disclosure, a top gate of the double-gate transistor is referred to as a first control electrode, and a bottom gate of the double-gate transistor is referred to as a second control electrode. A source and a drain of the transistor are symmetrical, and thus the source and the drain are not distinguished. That is, the source of the transistor may be a first electrode (or a second electrode), and the drain of the transistor may be the second electrode (or the first electrode). As shown in FIG. 1, a first control electrode of the drive transistor TD is coupled to a first node N1, a second control electrode of the drive transistor TD is coupled to a second node N2, a first electrode of the drive transistor TD is coupled to a first voltage signal terminal V1 (the first voltage signal terminal V1 provides a first voltage signal Vdd), and a second electrode of the drive transistor TD is coupled to a third node N3. The drive transistor TD may provide a drive current according to a voltage of the first node N1 and a voltage of the second node N2. In the embodiments, the drive transistor TD is a P-type double-gate transistor.

The data write circuit 110 may be coupled to a data line DL, a first drive signal terminal, and the first node N1. The data line DL may be provided with a reference signal REF or a data signal DATA in different phases. The data write circuit 110 may provide the reference signal REF or the data signal DATA from the data line DL to the first node N1 according to a first drive signal S1 from the first drive signal terminal.

The light emission control circuit 120 may be coupled to the third node N3, a pixel drive signal terminal, and the light emitting device 150. The light emission control circuit 120 may control, according to a pixel drive signal EM from the pixel drive signal terminal, to provide the drive current to the light emitting device 150.

The compensation circuit 130 may be coupled to a second drive signal terminal, the second node N2, and the third node N3. The compensation circuit 130 may control the voltage of the second node N2 to be equal to the voltage of the third node N3 according to a second drive signal S2 from the second drive signal terminal.

The reset circuit 140 may be coupled to a third voltage signal terminal V3, the second node N2, and a reset signal terminal. The reset circuit 140 may provide a third voltage signal Vinit from the third voltage signal terminal V3 to the second node N2 according to a reset signal RST from the reset signal terminal.

The light emitting device 150 may be coupled to the light emission control circuit 120 and the second voltage signal terminal V2. The second voltage signal terminal provides a second voltage signal Vss. The light emitting device 150 may emit light according to the drive current provided by the drive transistor TD under the control of the light emission control circuit 120.

In embodiments of the present disclosure, the drive transistor TD in the pixel circuit adopts a double-gate structure, and the threshold voltage of the drive transistor TD is determined by controlling the bottom gate voltage of the drive transistor TD to compensate the drive current of the drive transistor TD. The drive current of the drive transistor TD is merely related to the data signal DATA and the reference signal REF, and a concrete analysis thereof can be seen below. Thus, deviation and drift of the threshold voltage of the drive transistor TD may be compensated, and luminance difference caused by IR drop between a remote end and a near end with respective to a power source may be compensated. Furthermore, display uniformity may be improved since the drive current is unrelated to the threshold voltage of the drive transistor TD and the voltage of the power source.

Figure 2:
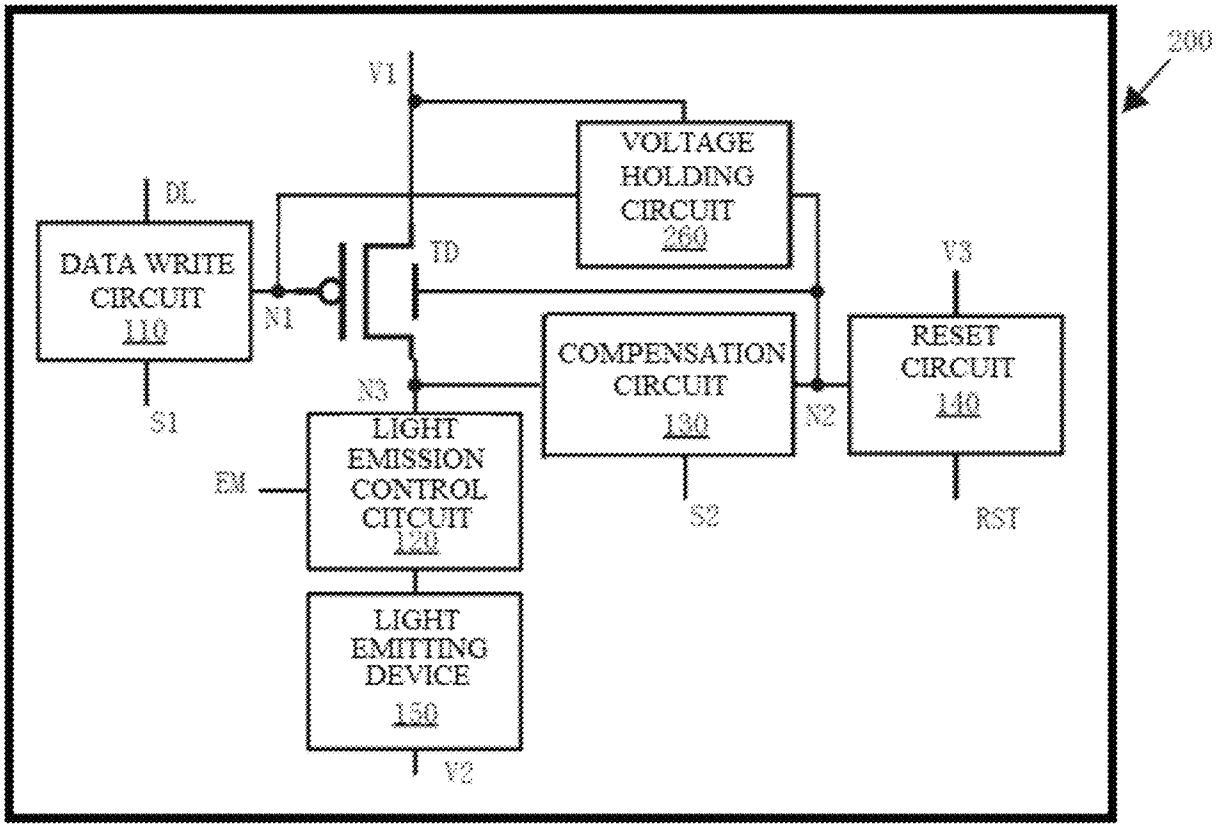
FIG. 2 illustrates a schematic block diagram of a pixel circuit according to another embodiment of the present disclosure.

FIG. 2 illustrates a schematic block diagram of a pixel circuit according to another embodiment of the present disclosure. As shown in FIG. 2, the pixel circuit 200 may include a drive transistor TD, a data write circuit 110, a light emission control circuit 120, a compensation circuit 130, a reset circuit 140, a light emitting device 150, and a voltage holding circuit 260.

In embodiments of the present disclosure, the voltage holding circuit 260 may be configured to hold a voltage difference between the first voltage signal terminal V1 and the first node N1, and/or hold a voltage difference between the first voltage signal terminal V1 and the second node N2. Besides of that, the pixel circuit in FIG. 2 has the same structure as the pixel circuit in FIG. 1, and thus its detailed description is omitted herein.

Figure 3:
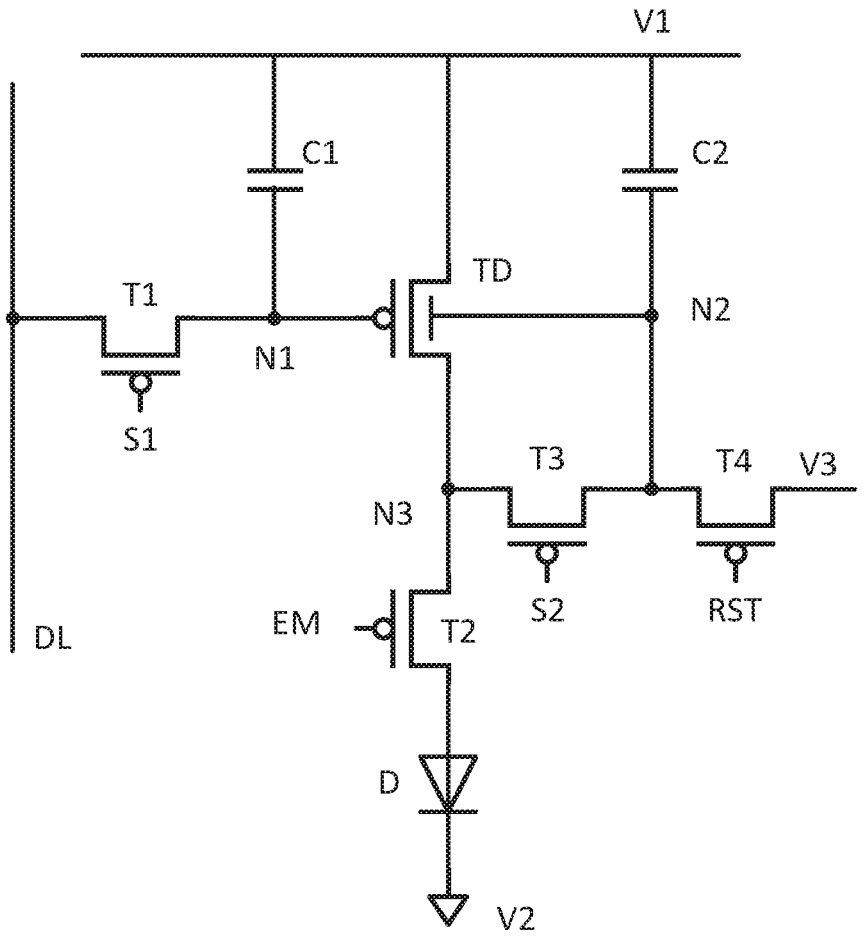
FIG. 3 illustrates an exemplary circuit diagram of a pixel circuit according to an embodiment of the present disclosure.

FIG. 3 illustrates an exemplary circuit diagram of a pixel circuit according to an embodiment of the present disclosure. In this embodiment, the employed transistor may be an N-type transistor or a P-type transistor. Specifically, the transistor may be an N-type or a P-type field-effect transistor (MOSFET) or an N-type or a P-type bipolar transistor (BJT). In embodiments of the present disclosure, a gate of the transistor is referred to as a control electrode. A source and a drain of the transistor are symmetrical, and thus the source and the drain are not distinguished. That is, the source of the transistor may be a first electrode (or a second electrode), and the drain of the transistor may be the second electrode (or the first electrode).

In embodiments of the present disclosure, a detailed description is made by taking the P-type field-effect transistor (PMOS transistor) as an example.

As shown in FIG. 3, a first control electrode of the drive transistor TD is coupled to the first node N1, a second control electrode of the drive transistor TD is coupled to the second node N2, a first electrode of the drive transistor TD is coupled to the first voltage signal terminal V1, and a second electrode of the drive transistor TD is coupled to the third node N3, to provide a drive current.

The data write circuit 110 may include a first transistor T1. A control electrode of the first transistor T1 is coupled to the first drive signal terminal to receive the first drive signal S1, a first electrode of the first transistor T1 is coupled to the data line DL, and a second electrode of the first transistor T1 is coupled to the first node N1. The first transistor T1 may transfer the reference signal REF or the data signal DATA from the data line DL to the first node N1 under the control of the first drive signal S1.

The light emission control circuit 120 may include a second transistor T2. A control electrode of the second transistor T2 is coupled to the pixel drive signal terminal to receive the pixel drive signal EM, a first electrode of the second transistor T2 is coupled to the third node N3, and a second electrode of the second transistor T2 is coupled to the light emitting device 150. The second transistor T2 may transfer the drive current Id provided by the drive transistor TD to the light emitting device 150 under the control of the pixel drive signal EM.

The compensation circuit 130 may include a third transistor T3. A control electrode of the third transistor T3 is coupled to the second drive signal terminal to receive the second drive signal S2, a first electrode of the third transistor T3 is coupled to the second node N2, and a second electrode of the third transistor T3 is coupled to the third node N3. The third transistor T3 may control, based on the second drive signal S2, the voltage of the second node N2 to be equal to that of the third node N3, i.e., control the voltage of the second control electrode (bottom gate) of the drive transistor TD to be equal to that of the second electrode (drain).

The reset circuit 140 may include a fourth transistor T4. A control electrode of the fourth transistor T4 is coupled to the reset signal terminal to receive the reset signal RST, a first electrode of the fourth transistor T4 is coupled to the third voltage signal terminal V3, and a second electrode of the fourth transistor T4 is coupled to the second node N2. The fourth transistor T4 may provide the third voltage signal Vinit from the third voltage signal terminal V3 to the second node N2 under the control of the reset signal RST.

A positive end of the light emitting device 150 (shown as the light emitting device D in the figure) is coupled to the third node N3 via the second transistor T2, and a negative end of the light emitting device 150 is coupled to the second voltage signal terminal V2. The light emitting device 150 may include, for example, one of a LED (light emitting diode), an OLED (organic light emitting diode), and an AMOLED (active matrix organic light emitting diode).

As shown in FIG. 3, in embodiments of the present disclosure, the pixel circuit may further include a voltage holding circuit 260. In an embodiment, the voltage holding circuit 260 may include a first capacitor C1. The first capacitor C1 may be coupled between the first voltage signal terminal V1 and the first node N1, to hold a voltage difference between the first voltage signal terminal V1 and the first node N1. In another embodiment, the voltage holding circuit 260 may include a second capacitor C2. The second capacitor C2 may be coupled between the first voltage signal terminal V1 and the second node N2 to hold a voltage difference between the first voltage signal terminal V1 and the second node N2. In addition, in other embodiments, the voltage holding circuit 260 may also include both the first capacitor C1 and the second capacitor C2.

In the embodiments of the present disclosure, the first drive signal S1 may be a gate drive signal for the pixel circuit. The second drive signal S2 may be a gate drive signal for another pixel circuit.

Figure 4:
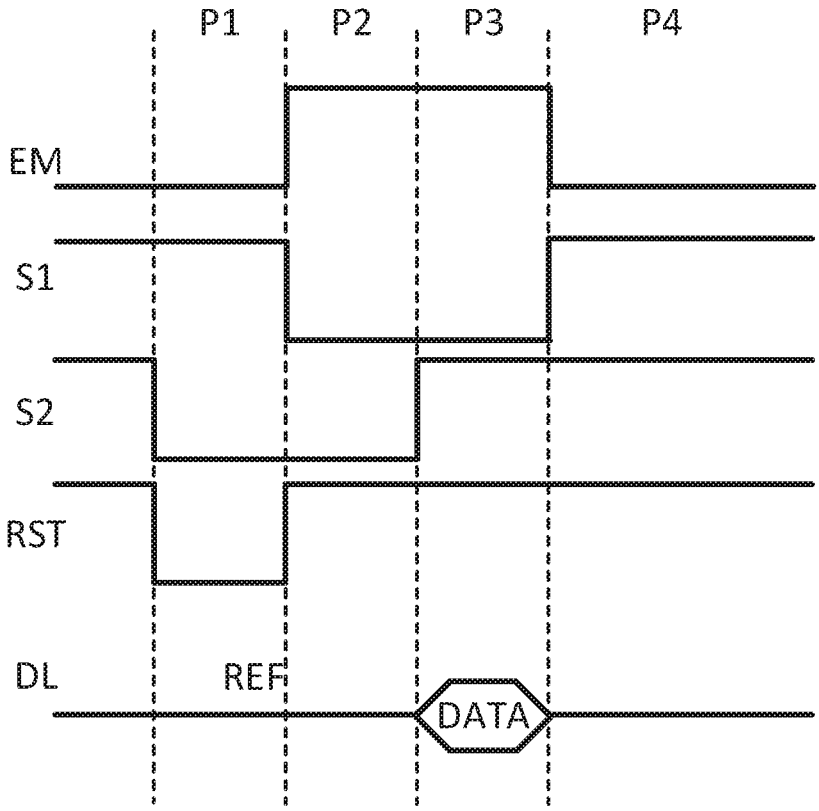
FIG. 4 illustrates a timing chart of signals in a pixel circuit according to an embodiment of the present disclosure.

FIG. 4 illustrates a timing chart of signals in a pixel circuit according to an embodiment of the present disclosure. The pixel circuit may be, for example, the pixel circuit as shown in FIG. 3. The first voltage signal Vdd is a high level signal, the second voltage signal Vss is a low level signal, and the third voltage signal Vinit is a low level signal.

In a P1 phase, the first drive signal S1 having a high level is provided, such that the first transistor T1 is turned off. The first node N1 holds the voltage of a signal provided by the data line DL in a previous phase (i.e., before the first transistor T1 is turned off). The second drive signal S2 and the reset signal RST having a low level are provided, such that the third transistor T3 and the fourth transistor T4 are turned on. The voltage of the second node N2 and the voltage of the third node N3 are reset by the third voltage signal Vinit to be equal. The pixel drive signal EM having a low level is provided to enable the second transistor T2. The voltage across the light emitting device D is changed into the second voltage signal Vss and the third voltage signal Vinit respectively, the light emitting device D is reset and thus may not emit light. In the P1 phase, the voltage of the second node N2 (i.e., the voltage of the second control electrode of the drive transistor TD) changes, and thus the threshold voltage Vth of the drive transistor TD also accordingly changes, which causes a current generated in the drive transistor TD to change. The abnormal current generated by the drive transistor TD may be derived out from the third voltage signal terminal V3 by the third transistor T3 and the fourth transistor T4. Therefore, the unstable current may not cause abnormal display.

In a P2 phase, the pixel drive signal EM and the reset signal RST having a high level are provided, such that the second transistor T2 and the fourth transistor T4 are turned off. The second drive signal S2 and the first drive signal S1 having a low level are provided, such that the first transistor T1 and the third transistor T3 are turned on. In the P2 phase, the reference signal REF is provided to the data line DL. The reference signal REF provided by the data line DL is transferred to the first node N1 via the first transistor T1. A current flowing from the first voltage signal terminal V1 to the third node N3 may be formed when the drive transistor TD is turned on. Then, the voltage of the third node and the voltage of the second node N2 rise to the equal voltage Vx. It is to be understood that the voltage Vx of the second node N2 may cause certain hole charges (fixed charges or non-conducting charges) of a back channel of the drive transistor TD to be controlled, and the remaining movable charges participate in electric conduction, wherein the movable conducting charges are in direct proportion to the threshold voltage Vth of the drive transistor. The drive transistor TD is turned off when a voltage difference between its first control electrode (the top gate) and first electrode (the source) is equal to the threshold voltage. That is, the threshold voltage of the drive transistor TD may be determined as the voltage difference between its first control electrode (the top gate) and first electrode (the source), i.e., Vth=VRef−Vdd.

In a P3 phase, the pixel drive signal EM, the second drive signal S2, and the reset signal RST having a high level are provided, such that the second transistor T2, the third transistor T3, and the fourth transistor T4 are turned off. Moreover, the data signal DATA is provided to the data line. The first drive signal S1 having a low level is provided to write the data signal DATA provided by the data line DL into the first node N1. The second capacitor C2 may hold the voltage difference between the first voltage signal terminal V1 and the second node N2 unchanged, i.e., hold the voltage of the second node N2 to be the voltage Vx. Thus, the threshold voltage Vth of the drive transistor TD is fixed to be Vth=VRef−Vdd. That is, when the data signal is written, the threshold voltage of the drive transistor TD is merely related to the reference signal REF and the first voltage signal Vdd.

In a P4 phase, the pixel drive signal EM having a low level is provided, such that the second transistor T2 is turned on. The second drive signal S2, the first drive signal S, and the reset signal RST having a high level are provided, such that the first transistor T1, the third transistor T3, and the fourth transistor T4 are turned off. The first capacitor C1 may hold the voltage difference between the first node and the first voltage signal terminal unchanged, i.e., hold the voltage of the first node N1 to be the voltage of the data signal DATA (Vdata). The second capacitor C2 may hold the voltage of the second node N2 to be the voltage Vx. The threshold voltage of the drive transistor remains unchanged (i.e., Vth=VRef−Vdd) because the voltage of the bottom gate of the drive transistor remains unchanged. The first electrode (the source) of the drive transistor TD is Vs=Vdd, and the first control electrode (the top gate) is Vg=Vdata. Based on a current formula, the drive current of the drive transistor is related to the voltage of the top gate, the source voltage and the threshold voltage, i.e., is related to Vgs−Vth. Specifically, by calculation it may be obtained Vgs−Vth=Vdata−Vdd−VRef+Vdd=Vdata−VRef. Therefore, the drive current is merely related to the data signal DATA and the reference signal REF, and thus it is avoided the adverse effect caused by threshold voltage deviation and different distances from the location of the power source. Further, to ensure the drive transistor TD to operate in a saturation region, the voltage of the data signal DATA should be less than the voltage of the reference signal REF, the voltage of the reference signal REF should be less than the voltage of the first voltage signal Vdd, i.e., Vdata<VRef<Vdd, and Vgd=Vdata−Vss−Voled>Vth. Thus, in the P4 phase, the light emitting device D may emit light based on the drive current provided by the drive transistor TD.

Figure 5:
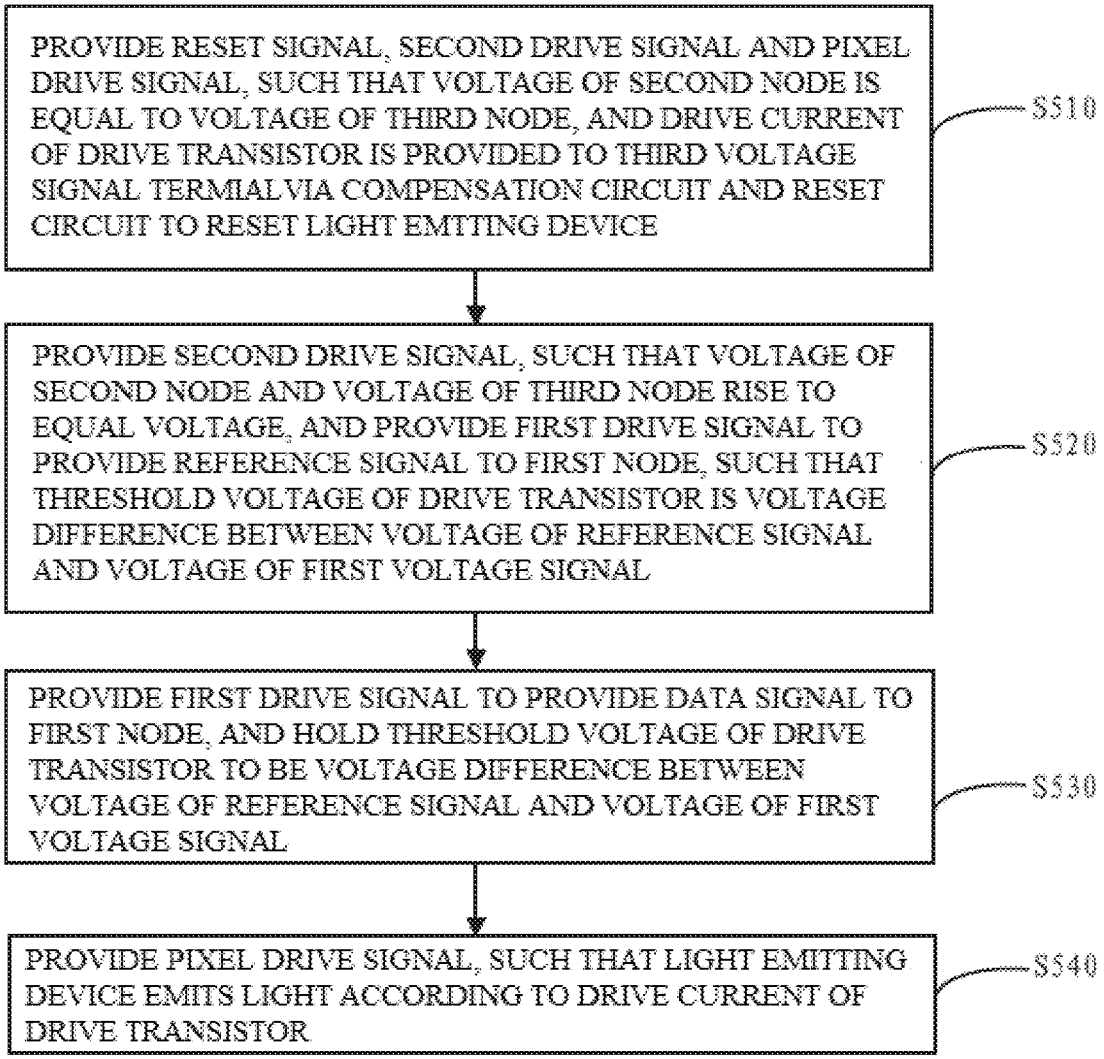
FIG. 5 illustrates a flowchart of a method for driving a pixel circuit according to an embodiment of the present disclosure.

FIG. 5 illustrates a schematic flowchart of a method for driving a pixel circuit according to an embodiment of the present disclosure.

In this method, in Step S510, the reset signal, the second drive signal, and the pixel drive signal are provided, such that the voltage of the second node is equal to the voltage of the third node, and the drive current of the drive transistor is provided to the third voltage signal terminal via the compensation circuit and the reset circuit to reset the light emitting device.

At Step S520, the second drive signal is provided to provide the reference signal to the data line. The voltage of the second node and the voltage of the third node rise to the equal voltage. The first drive signal may be provided to provide the reference signal from the data line to the first node (i.e., the first control electrode of the drive transistor). The first voltage signal is provided to the first electrode (source) of the drive transistor. The threshold voltage of the drive transistor is the voltage difference between the voltage of the reference signal and the voltage of the first voltage signal.

Then, at Step S530, the first drive signal is provided, and the data signal is provided to the data line, to provide the data signal from the data line to the first node. The voltage of the bottom gate of the drive transistor is held unchanged, and thus the threshold voltage of the drive transistor is held to be the voltage difference between the voltage of the reference signal and the voltage of the first voltage signal.

At Step S540, the pixel drive signal is provided to control the light emitting device to emit light based on the drive current. The drive current is related to the data signal and the reference signal.

Figure 6:
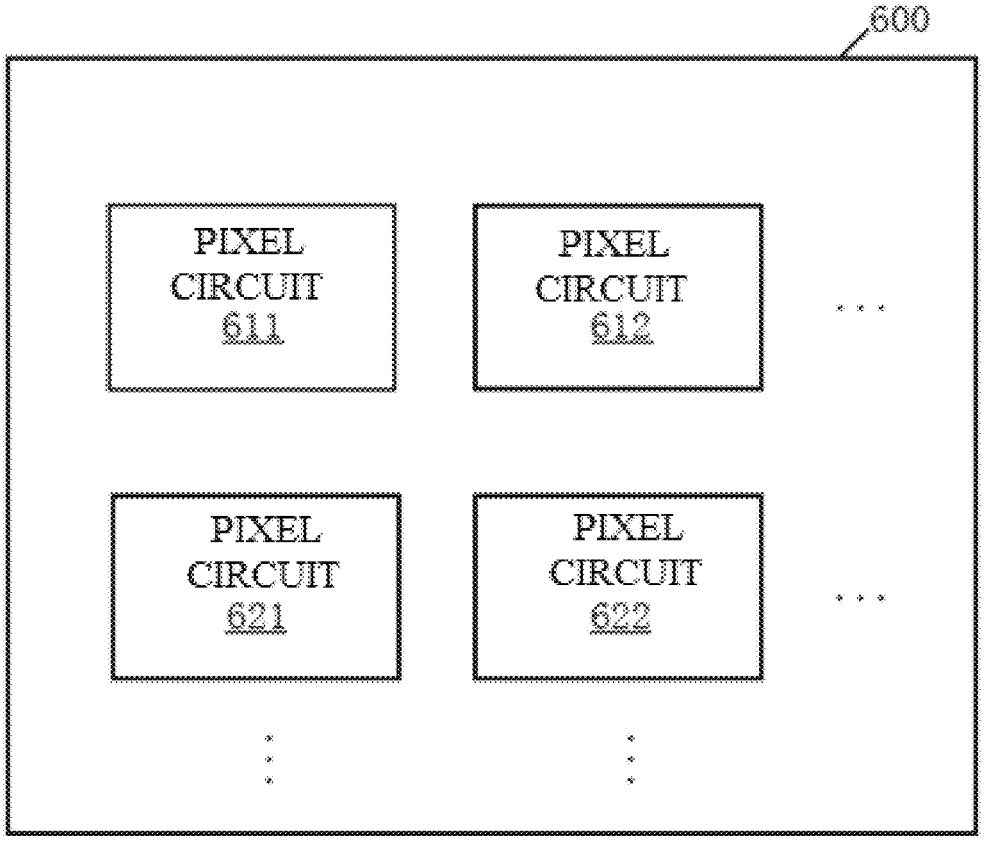
FIG. 6 illustrates a schematic diagram of an array substrate according to an embodiment of the present disclosure.

FIG. 6 illustrates a schematic diagram of an array substrate according to an embodiment of the present disclosure. The array substrate 600 may include a plurality of pixel circuits, for example, the pixel circuit 611, the pixel circuit 612, the pixel circuit 621, the pixel circuit 622 and so on according to the embodiments of the present disclosure. As shown in FIG. 6, the plurality of pixel circuits may be arranged in a matrix.

According to the embodiments of the present disclosure, deviation and drift of the threshold voltage of the drive transistor in the plurality of pixel circuits may be compensated, and luminance difference caused by IR drop between a remote end and a near end for a power source may be compensated, and thus display uniformity and display quality may be improved.

In the embodiments of the present disclosure, the array substrate may further include a plurality of cascade-coupled gate driving transistors. A gate drive signal provided by the $(n-1)^{th}$ stage gate driving transistor may serve as the second drive signal S2 for the $n^{th}$ rows of pixel circuits, and a gate drive signal provided by the $n^{th}$ stage gate driving transistor may serve as the first drive signal S1 for the $n^{th}$ rows of pixel circuits.

In another aspect, embodiments of the present disclosure also provide a display panel including the above array substrate and a display apparatus including the display panel. The display apparatus may be, for example, a display screen, a mobile phone, a tablet computer, a camera, and a wearable device, etc.

According to embodiments of the present disclosure, the drive transistor in the pixel circuit adopts a double-gate structure, and it is ensured that the threshold voltage of the drive transistor remains unchanged by controlling the bottom gate voltage of the drive transistor unchanged. After the threshold voltage is determined, the drive current may be represented as merely being related to the data signal and the reference signal but unrelated to the power source voltage. In this way, display unevenness caused by deviation of the threshold voltage Vth of the drive transistor may be avoided. Adverse effect of the power source voltage variation caused by IR Drop between the remote end and the near end for the power source may be reduced, and thus display uniformity may be improved.

A plurality of embodiments of the present disclosure are described in detail above. However, the scope of protection of the present disclosure is not limited thereto. Apparently, those of ordinary skill in the art may make various modifications, substitutions, and variations on the embodiments of the present disclosure without departing from the spirit and scope of the present disclosure. The scope of protection of the present disclosure is limited by the appended claims.

What is claimed is:

1. A method for driving a pixel circuit, wherein the pixel circuit comprises a drive transistor, a data write circuit, a light emission control circuit, a compensation circuit, a reset circuit, and a light emitting device, wherein a first control electrode of the drive transistor is coupled to a first node, wherein a second control electrode of the drive transistor is coupled to a second node, wherein a first electrode of the drive transistor is coupled to a first voltage signal terminal, wherein a second electrode of the drive transistor is coupled to a third node, and wherein the drive transistor is configured to provide a drive current;

wherein the data write circuit is configured to provide a reference signal or a data signal from a data line to the first node according to a first drive signal from a first drive signal terminal;

wherein the light emission control circuit is configured to control, according to a pixel drive signal from a pixel drive signal terminal, to provide the drive current to the light emitting device;

wherein the compensation circuit is configured to control a voltage of the second node to be equal to a voltage of the third node according to a second drive signal from a second drive signal terminal;

wherein the reset circuit is configured to provide a third voltage signal from a third voltage signal terminal to the second node according to a reset signal from a reset signal terminal; and wherein the light emitting device is coupled between the light emission control circuit and a second voltage signal terminal and is configured to emit light according to the drive current;

wherein the method comprises:

providing the reset signal, the second drive signal, and the pixel drive signal, such that the voltage of the second node is equal to the voltage of the third node, and the drive current of the drive transistor is provided to the third voltage signal terminal via the compensation circuit and the reset circuit to reset the light emitting device;

providing the second drive signal, such that the voltage of the second node and the voltage of the third node rise to the equal voltage, and providing the first drive signal to provide the reference signal to the first node, such that the threshold voltage of the drive transistor is a voltage difference between a voltage of the reference signal and a voltage of a first voltage signal from the first voltage signal terminal;

providing the first drive signal to provide the data signal to the first node, and holding the threshold voltage of the drive transistor to be the voltage difference between the voltage of the reference signal and the voltage of the first voltage signal; and providing the pixel drive signal, such that the light emitting device emits light according to the drive current of the drive transistor.

2. The method according to claim 1, wherein the first drive signal is a gate drive signal for the pixel circuit; and wherein the second drive signal is a gate drive signal for another pixel circuit.

3. The method according to claim 1, wherein a voltage of the data signal is smaller than a voltage of the reference signal, and wherein the voltage of the reference signal is smaller than a voltage of the first voltage signal from the first voltage signal terminal.

4. An array substrate comprising:

a plurality of pixel circuits, the plurality of pixel circuits arranged in a matrix;

wherein each of the pixel circuits comprises a drive transistor, a data write circuit, a light emission control circuit, a compensation circuit, a reset circuit, and a light emitting device, wherein a first control electrode of the drive transistor is coupled to a first node, wherein a second control electrode of the drive transistor is coupled to a second node, wherein a first electrode of the drive transistor is coupled to a first voltage signal terminal, wherein a second electrode of the drive transistor is coupled to a third node, and wherein the drive transistor is configured to provide a drive current;

wherein the data write circuit is configured to provide a reference signal or a data signal from a data line to the first node according to a first drive signal from a first drive signal terminal;

wherein the light emission control circuit is configured to control, according to a pixel drive signal from a pixel drive signal terminal, to provide the drive current to the light emitting device;

wherein the compensation circuit is configured to control a voltage of the second node to be equal to a voltage of the third node according to a second drive signal from a second drive signal terminal;

wherein the reset circuit is configured to provide a third voltage signal from a third voltage signal terminal to the second node according to a reset signal from a reset signal terminal; and wherein the light emitting device is coupled between the light emission control circuit and a second voltage signal terminal and is configured to emit light according to the drive current wherein the array substrate further comprises a plurality of cascade-coupled gate driving transistors, wherein a gate drive signal provided by the $(n-1)^{th}$ stage gate driving transistor serves as a second drive signal of the $n^{th}$ row of pixel circuits, and wherein a gate drive signal provided by the $n^{th}$ stage gate driving transistor serves as a first drive signal of the $n^{th}$ row of pixel circuits.

5. The array substrate according to claim 4, wherein the pixel circuit further comprises:

a voltage holding circuit, configured to hold at least one of a voltage difference between a first voltage signal terminal and a first node, and a voltage difference between a first voltage signal terminal and a second node.

6. The array substrate according to claim 5, wherein the voltage holding circuit comprises at least one of:

a first capacitor coupled between the first voltage signal terminal and the first node; and a second capacitor coupled between the first voltage signal terminal and the second node.

7. The array substrate according to claim 4, wherein a voltage of the data signal is smaller than a voltage of the reference signal, and wherein the voltage of the reference signal is smaller than a voltage of a first voltage signal from the first voltage signal terminal.

8. A display panel comprising the array substrate according to claim 4.

9. The display panel according to claim 8, wherein the pixel circuit further comprises:

a voltage holding circuit, configured to hold at least one of a voltage difference between a first voltage signal terminal and a first node, and a voltage difference between a first voltage signal terminal and a second node.

* * * * *